US008678194B2

(12) United States Patent
Rem et al.

(10) Patent No.: US 8,678,194 B2
(45) Date of Patent: Mar. 25, 2014

(54) USE OF AN APPARATUS FOR SEPARATING MAGNETIC PIECES OF MATERIAL

(75) Inventors: Peter Carlo Rem, Rijswijk (NL); Simon Peter Maria Berkhout, Schipluiden (NL)

(73) Assignee: Technische Universiteit Delft, Delft (NE)

( * ) Notice: Subject to any disclaimer, the term of this patent is extended or adjusted under 35 U.S.C. 154(b) by 50 days.

(21) Appl. No.: 13/269,943

(22) Filed: Oct. 10, 2011

(65) Prior Publication Data

US 2012/0085685 A1 Apr. 12, 2012

Related U.S. Application Data

(63) Continuation of application No. PCT/NL2010/050184, filed on Apr. 7, 2010.

(30) Foreign Application Priority Data

Apr. 9, 2009 (NL) ..... 2002736

(51) Int. Cl.
*B03C 1/00* (2006.01)

(52) U.S. Cl.
USPC ..... 209/214; 209/225

(58) Field of Classification Search
USPC ..... 209/214, 223.1, 224, 225, 631, 636, 209/930
See application file for complete search history.

(56) References Cited

U.S. PATENT DOCUMENTS

| | | | | |
|---|---|---|---|---|
| 1,166,682 | A * | 1/1916 | Henderson | 209/223.2 |
| 1,453,699 | A * | 5/1923 | Brophy | 209/8 |
| 1,522,343 | A | 1/1925 | Thom | |
| 2,056,426 | A | 10/1936 | Frantz | |
| 2,291,042 | A * | 7/1942 | Kennedy | 209/40 |
| 2,690,263 | A | 9/1954 | Box | |
| 3,057,477 | A | 10/1962 | Rappaport | |
| 4,062,765 | A | 12/1977 | Fay et al. | |
| 4,069,145 | A | 1/1978 | Sommer | |
| 4,083,774 | A | 4/1978 | Hunter | |
| 4,248,700 | A * | 2/1981 | Paterson et al. | 209/212 |
| 4,324,657 | A | 4/1982 | Garrett | |
| 4,621,928 | A | 11/1986 | Schjreiber | |
| 4,623,470 | A | 11/1986 | Adler | |
| 4,743,364 | A | 5/1988 | Kyrazis | |
| 4,781,821 | A * | 11/1988 | Salmi | 209/214 |
| 4,834,870 | A * | 5/1989 | Osterberg et al. | 209/38 |
| 4,874,507 | A | 10/1989 | Whitlock | |
| 5,011,022 | A | 4/1991 | Palepu et al. | |

(Continued)

FOREIGN PATENT DOCUMENTS

| | | |
|---|---|---|
| AU | 726763 | 11/2000 |
| DE | 729487 | 12/1942 |

(Continued)

*Primary Examiner* — Joseph C Rodriguez
(74) *Attorney, Agent, or Firm* — Jeffrey D. Myers; Justin R. Jackson; Peacock Myers, P.C.

(57) ABSTRACT

An apparatus for separating magnetic pieces of scrap-material of a first group from magnetic pieces of scrap-material of a second group, wherein a mixture of pieces of scrap-material from the first group and from the second group is collectively transported with a conveyor to a separating zone, in which separating zone the pieces or scrap-material are subjected to forces induced by a magnetic field and to gravitational forces.

11 Claims, 1 Drawing Sheet

(56) References Cited

U.S. PATENT DOCUMENTS

| | | | | |
|---|---|---|---|---|
| 5,224,604 | A | 7/1993 | Duczmal et al. | |
| 5,394,991 | A * | 3/1995 | Kumagai et al. | 209/212 |
| 5,423,433 | A * | 6/1995 | Arnold et al. | 209/636 |
| 5,655,664 | A * | 8/1997 | Barrett | 209/212 |
| 5,957,298 | A | 9/1999 | Buske et al. | |
| 5,968,820 | A | 10/1999 | Zborowski et al. | |
| 6,138,833 | A | 10/2000 | Matsufuji et al. | |
| 6,364,117 | B1 | 4/2002 | Takano et al. | |
| 6,568,612 | B1 | 5/2003 | Aoki et al. | |
| 6,708,828 | B2 | 3/2004 | Miles | |
| 6,822,180 | B2 | 11/2004 | Fujii et al. | |
| 6,899,230 | B2 * | 5/2005 | Wise | 209/213 |
| 7,210,581 | B2 * | 5/2007 | Robinson et al. | 209/221 |
| 7,367,457 | B2 * | 5/2008 | Warlitz et al. | 209/225 |
| 7,726,493 | B2 * | 6/2010 | Van Der Weijden et al. | 209/218 |
| 7,741,574 | B2 | 6/2010 | Stencel et al. | |
| 2003/0044832 | A1 | 3/2003 | Blankenstein | |
| 2003/0165812 | A1 | 9/2003 | Takayama et al. | |
| 2004/0050756 | A1 | 3/2004 | Flagan | |
| 2009/0047297 | A1 | 2/2009 | Kim et al. | |
| 2009/0301296 | A1 | 12/2009 | Hoijtink et al. | |
| 2011/0042274 | A1 | 2/2011 | Rem et al. | |
| 2011/0049017 | A1 | 3/2011 | Rem et al. | |
| 2012/0085684 | A1 | 4/2012 | Rem et al. | |

FOREIGN PATENT DOCUMENTS

| | | |
|---|---|---|
| DE | 1051752 | 3/1959 |
| DE | 4014969 | 5/1990 |
| DE | 102004040785 | 3/2006 |
| DE | 102005032661 | 7/2007 |
| EP | 1181982 | 2/2002 |
| EP | 1800753 | 6/2007 |
| EP | 1878505 | 1/2008 |
| FR | 1348410 | 12/1964 |
| GB | 1602279 | 11/1981 |
| GB | 679277 | 9/2005 |
| OA | 392 | 5/1966 |
| WO | WO-0126793 | 4/2001 |
| WO | WO-03053588 | 7/2003 |
| WO | WO-2006021410 | 3/2006 |
| WO | WO-2006138314 | 12/2006 |

* cited by examiner

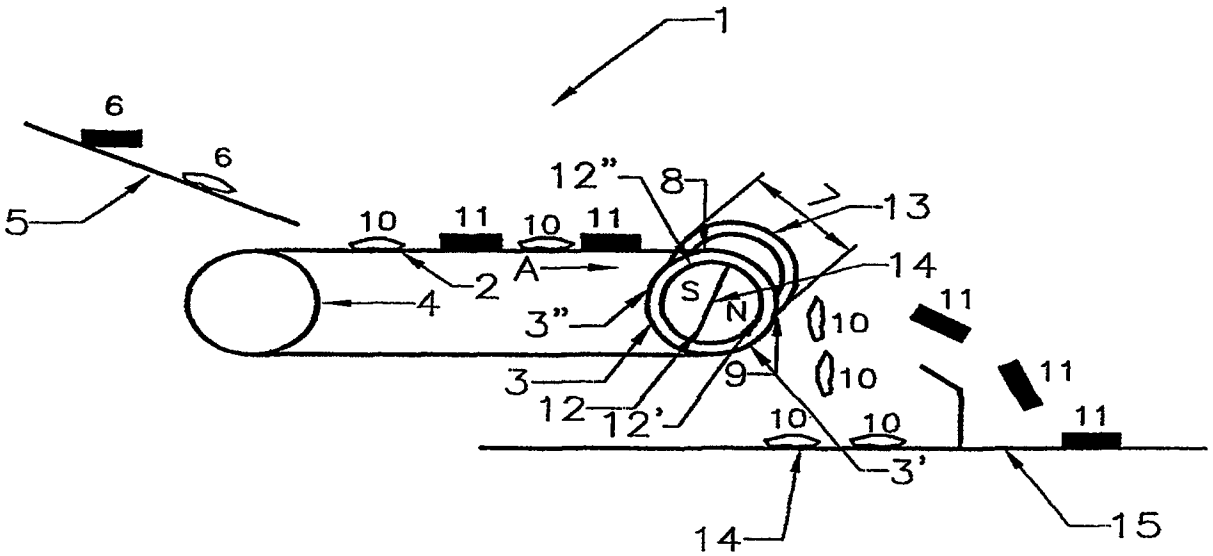
1
2
3
3'
3"
4
5
6
6
7
8
9
10
10
10
10
10
11
11
11
11
11
12
12'
12"
13
14
14
15
A
S
N

USE OF AN APPARATUS FOR SEPARATING MAGNETIC PIECES OF MATERIAL

CROSS-REFERENCE TO RELATED APPLICATIONS

This application is a continuation application of International Patent Application Serial No. PCT/NL2010/050184, entitled "Use of an Apparatus for Separating Magnetic Pieces of Material", to Technische Universiteit Delft, filed on Apr. 7, 2010, which is a continuation of Netherlands Patent Application Serial No. 2002736, entitled "Use of an Apparatus for Separating Magnetic Pieces of Material", to Technische Universiteit Delft, filed on Apr. 9, 2009, and the specifications and claims thereof are incorporated herein by reference.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

COPYRIGHTED MATERIAL

Not Applicable.

BACKGROUND OF THE INVENTION

1. Field of the Invention (Technical Field)

The present invention relates to the use of an apparatus for separating magnetic pieces of scrap-material of a first group from magnetic pieces of scrap-material of a second group, wherein a mixture of pieces of scrap-material from the first group and from the second group is collectively transported with a conveyor to a separating zone, in which separating zone the pieces of scrap-material are subjected to forces induced by a magnetic field and to gravitational forces.

2. Description of Related Art

A method of separating magnetic pieces of scrap-material of a first group from magnetic pieces of scrap-material of a second group is known from U.S. Pat. No. 6,364,117.

In the known method pieces of material, at least some of which are magnetic pieces, are separated from other pieces of material. In particular it is known from the prior art that iron sheets are separated from wasted iron products, which are parts of wasted electric products such as air-conditioners or refrigerators. In the prior art a mixture of sheet shaped scrap and ferrous cast blocks are transported by a moving conveyor and subjected to a magnetic force above the conveyor in order to re-cycle suitable iron pieces so as to be thrown into a furnace and recycled as cast material. The magnetic field provides an upwardly directed force to the magnetic pieces of material which is used to effect a separation between the sheet shaped scrap and the ferrous cast blocks. The separation is occasioned by the circumstance that the magnetic force applied on the sheet shaped scrap is stronger than the force on the same weight cast block.

Although it is possible according to U.S. Pat. No. 6,364,117 to separate different pieces of magnetic material from each other, it is still required that the first group of magnetic pieces of material distinguishes strongly from the second group of magnetic pieces of material so as to be able to effect a reliable separation. Notably sheet shaped scraps have quite different characteristics than ferrous cast blocks, in view of which it is possible to separate them from each other.

EP I 878 505 discloses an apparatus having a separating zone for separating magnetic pieces of scrap-material of a first group from magnetic pieces of scrap-material of a second group, which apparatus further comprises a conveyor for transporting a mixture of said pieces of scrap-material from the first group and from the second group to the separating zone, at which separating zone the mixture of pieces of scrap material is subjected to a magnetic field and wherein at the separation zone the conveyor is supported by a drum around which the conveyor passes at a pre-defined speed so as to impart on the mixture of magnetic pieces of scrap-material a pre-defined horizontal velocity at which said pieces are released from the conveyor at said separating zone so as to subject the pieces of scrap-material to forces induced by the magnetic field and to gravitational forces. The mixture of scrap-material concerns a first group of liberated scrap, that means fragments which essentially do not contain materials other than iron and steel, and a second group of non-liberated scrap that means fragments that do also contain other materials, in particular copper.

BRIEF SUMMARY OF THE INVENTION

It is an object of the invention to enable a separation of a first group of magnetic pieces of material from a second group of magnetic pieces of material in which the characterizing features of the material from the first group do not have to distinguish significantly from the features of the magnetic pieces of material from the second group. It is thus an object of the invention to make it possible to separate magnetic pieces of material that are only moderately distinguishable from each other.

Another object of the invention is to provide a viable alternative for the method known from U.S. Pat. No. 6,364,117.

Still another object of the invention is to be able to provide separate groups of material which can then also be separately applied in an electrical melting furnace for steel. Practice learns that this is beneficial for the steel melting process in such a furnace.

The objects of the invention are promoted by the features of one or more of the appended claims.

BRIEF DESCRIPTION OF THE SEVERAL VIEWS OF THE DRAWINGS

The invention will hereinafter be further elucidated with reference to the drawing of an exemplary embodiment of an apparatus that is used in accordance with the invention.

In the drawing a single FIG. 1 shows an apparatus 1 embodied with a conveyor belt 2 that moves at a pre-defined speed, for instance at least 2.5 m/s, and preferably at least 3 m/s in the direction of arrow A.

The conveyor belt 2 moves around drums 3, 4 and thus constitutes an endless conveyor belt.

DETAILED DESCRIPTION OF THE INVENTION

In a first aspect of the invention the apparatus known from EP I 878 505 is used for separating magnetic pieces of scrap-material of a first group from magnetic pieces of scrap-material of a second group, wherein the first group of material concerns ferrous scrap with a bulk-density of less than 900 $kg/m^3$ and the second group of material concerns ferrous scrap with a bulk-density of more than 900 $kg/m^3$. Surprisingly it has been found that by using the known apparatus according to the invention reliably distinct paraboles are obtained that are characteristic for the respective first group of materials and second group of materials, enabling to reliably separate ferrous scrap with a bulk-density of less than 900 kg/m$^3$ from ferrous scrap with a bulk-density of more than 900 kg/m$^3$.

In a further aspect of the invention the forces induced by the magnetic field on the magnetic pieces of scrap-material in the separation zone are constantly and without alternating component attracting said magnetic pieces of scrap-material towards the drum.

It is remarked that U.S. Pat. No. 4,781,821 discloses a process for separating magnetic particles from non-magnetic particles using a short belt magnetic separator having a pulley head with axial pole permanent magnets located within said pulley head. This known apparatus is used in a method in which weakly magnetic material is separated from strongly magnetic material. It concerns, however, in the method according to U.S. Pat. No. 4,781,821 a separation process for ore particles which is neither intended nor suitable for separating a mixture of pieces of scrap-material, all having magnetic properties. Moreover in the method disclosed in U.S. Pat. No. 4,781,821 a plurality of axial pole magnets is used with alternating poles near to the drum-surface causing that there is no constant attracting magnetic force that is aimed towards the drum, when hypothetically speaking this known method would be used for separating scrap-material. The inventors have found that it is particularly the constant attracting magnetic force without alternating component that acts on the magnetic pieces of scrap-material that contributes in effecting a reliable separation of different pieces of scrap-material that exhibit only modestly differentiating parameters.

In order to realize that the forces induced by the magnetic field in the separate zone on the magnetic pieces of scrap-material is constant and without alternating component, it is desirable that the magnetic field lines in the separation zone are unidirectional. This way all magnetic field lines commonly work on the magnetic pieces of scrap-material to attract this material towards the drum.

It has further been found advantageous that the magnetic field has magnetic field lines that collectively span the entire separation zone and that the magnetic field lines share a departure area and arrival area respectively on the drum, which departure area and arrival area are on distinct halves of said drum. This secures that the forces that act on the magnetic pieces of scrap-material whilst said material is conveyed through the separation zone gradually increase to a pre-defined constant value, and decline again when the pieces of scrap material are released from the conveyor due to their forward velocity as imparted on the material by the conveyor.

A suitable way to implement the desirable features of the magnetic field lines in the separation zone is by having the magnetic field induced by a single magnet, placed in the drum.

It is preferred then that the magnetic field is induced by a single dipole magnet having a plane separating a north-pole from a south-pole of said magnet that is at a 45° angle with respect to the horizon.

In order to effect an adequate separation in the separation zone without sacrificing throughput, it. is preferable that the conveyor moves at a pre-defined speed of at least 2.5 m/s, and preferably at least 3 m/s. In connection therewith it is further desirable that, the magnetic field has a strength selected in dependence of the conveyor speed, preferably approximately 0.15 Tesla at a belt speed of 3-3.5 m/s.

Another aspect of the invention concerns a method of making steel in an electrical melting furnace, comprising the step of introducing scrap-material into the furnace making use of the separate groups of material that are obtained by using the known apparatus in the above explained manner according to the invention. This steel making process can now be beneficially executed such that the scrap-material is introduced into the furnace in sets of layers whereby for every set of two layers a first layer concerns ferrous scrap of a first group of material with a bulk-density of less than 900 kg/m$^3$, and a second layer which is placed on top of the first layer and concerns ferrous scrap of a second group of material with a bulk-density of more than 900 kg/m$^3$. This promotes an effective processing of the group of material having the lower bulk-density of less than 900 kg/m$^3$.

The apparatus 1 further has a feed trough 5 for bringing pieces of scrap-material 6 onto the conveyor belt 2. As mentioned the conveyor belt 2 moves in the direction A towards drum 3, at which drum 3 a separation zone 7 is present. The entry section of the separation zone 7 is indicated with reference numeral 8, whereas the exit section of the separation zone is indicated with reference numeral 9.

Due to the movement speed of the conveyor belt 2 in the direction A, a pre-defined horizontal velocity is imparted on the pieces of scrap-material 10 and 11 respectively upon their release from the conveyor 2.

In the drum 3 that supports the conveyor belt 2, a magnet 12 is placed inducing magnetic field lines 13 in the separation zone 7 which inflict magnetic forces on the pieces of scrap-material 10, 11. These forces in combination with the forces due to gravity and the horizontal velocity imparted on the pieces of scrap-material 10, 11 by the movement of the conveyor belt 2 cause a separation between the pieces of scrap-material 10 forming part of a first group and the pieces of scrap-material 11 forming part of a second group.

It has been found that it is possible to reliably separate pieces of scrap-material 10 forming part of the first group that avail of a bulk-density of less than 900 kg/m$^3$, and that the pieces of scrap material 11 forming part of the second group may avail of a bulk-density of more than 900 kg/m$^3$. The FIGURE shows that the scrap-material 10 of the first group assumes a parabole upon release from the conveyor causing it to be collected in an area 14 close to the drum 3. The scrap-material 11 of the second group on the other hand gets collected in an area 15 more distant from the drum 3 than area 14 due to the differentiating parabole that the scrap-material 11 assumes upon release from the conveyor 2.

In order to effect a reliable separation with such only modestly distinguishing parameters between the pieces of scrap-material 10 of the first group and the pieces of scrap-material 11 of the second group, it is preferable that the forces induced by the magnetic field lines 13 in the separation zone 7 are constantly and without alternating component attracting the magnetic pieces of scrap-material 10, 11 towards the drum 3. As the FIGURE shows in connection with this requirement it is beneficial that the magnetic field lines 13 in the separation zone 7 are unidirectional.

The FIGURE further shows that the magnetic field lines 13 collectively span the entire separation zone 7 and even go beyond the entry section 8 and exit section 9. Further the said magnetic field lines 13 share a departure area 12' and arrival area 12" respectively which are on distinct halves 3' and 3" of the drum 3.

The FIGURE shows the preferred embodiment in which there is a single dipole magnet 12 having a plane 14 that separates a north pole N from a south pole S of said magnet 12 and that this plane 14 is at a 45°-angle with respect to the horizon.

The strength of the magnetic fields is preferably selected in dependence of the movement-speed of the conveyor belt 2 and amounts preferably approximately 0.15 Tesla at a belt speed of 3-3.5 m/s.

EXAMPLE

The apparatus as discussed hereinabove with reference to FIG. 1 was used to separate magnetic pieces of scrap material of a first group from magnetic pieces of scrap material of a second group.

In a first case the scrap material originated from so called end-of-life vehicles. In this case the first group of material exhibited a bulk density of 0.66 ton/cubic meter, and the second group of material exhibited a bulk density of 1.29 ton/cubic meter.

In a second case the scrap material was waste from electrical and electronic equipment. Then the first group of material exhibited a bulk density of 0.73 ton/cubic meter, and the 2nd group of material exhibited a bulk density of 0.93 ton/cubic meter.

It is expressly noted that the above-given description and example merely serves to elucidate the features of the claims without intend to limit the scope of said claims to only the offered example. The scope of protection that merits the invention is entirely and exclusively determined by the wording of said claims without intend to disclaim any feature that might be qualified as equivalent to any of the features disclosed. Also variations to the offered example are without restriction possible without departing from the scope of the invention as defined by the appended claims.

What is claimed is:

1. A method of using an apparatus having a separating zone for separating magnetic pieces of scrap-material of a first group from magnetic pieces of scrap-material of a second group, the method comprising the steps of:

transporting via a conveyor a mixture of said pieces of scrap-material from the first group and from the second group to the separating zone;

subjecting at the separating zone the mixture of pieces of scrap material to a magnetic field; and supporting at the separation zone the conveyor by a drum around which the conveyor passes at a predefined speed so as to impart on the mixture of magnetic pieces of scrap-material a pre-defined horizontal velocity at which said pieces are released from the conveyor at separating zone so as to subject the pieces of scrap-material to forces induced by the magnetic field and to gravitational forces; and wherein the first group of material concerns ferrous scrap with a bulk-density of less than 900 kg/m$^3$ and the second group of material concerns ferrous scrap with a bulk-density of more than 900 kg/m$^3$.

2. The method according to claim 1, wherein the forces induced by the magnetic field on the magnetic pieces of scrap-material in the separation zone are constantly and without alternating component attracting said magnetic pieces of scrap-material towards the drum.

3. The method according to claim 1, wherein the agnetic field has magnetic field lines in the separation zone that are unidirectional.

4. The method according to claim 1, wherein the magnetic field has magnetic field lines that collectively span the entire separation zone and the magnetic field lines share a departure area and arrival area respectively on the drum, which departure area and arrival area are on distinct halves of said drum.

5. The method according to claim 1, wherein the magnetic field is induced by a single magnet placed in the drum.

6. The method according to claim 1, wherein the magnetic field is induced by a single dipole magnet having a plane separating a north-pole (N) from a south-pole (S) of said magnet that is at a 45° angle with respect to the horizon.

7. The method according to claim 1, wherein the conveyor moves at a pre-defined speed of at least 2.5 m/s.

8. The method according to claim 7, wherein the conveyor moves at a pre-defined speed of at least 3 m/s.

9. The method according to claim 1, wherein the magnetic field has a strength selected in dependence upon the conveyor speed.

10. The method according to claim 9, wherein the magnetic field has a strength of approximately 0.15 Tesla at a belt speed of 3-3.5 m/s.

11. The method according to claim 1, wherein the scrap material is selected from the group consisting of end-of-life vehicles, and waste from electrical and electronic equipment.

* * * * *